US005191748A

United States Patent [19]

Baughman

[11] Patent Number: 5,191,748

[45] Date of Patent: Mar. 9, 1993

[54] ILLUMINATED DISPLAY

[76] Inventor: Daniel G. Baughman, Rte. 1, Box 624, Fontana, Wis. 53125

[21] Appl. No.: 806,864

[22] Filed: Dec. 12, 1991

[51] Int. Cl.[5] ..... E04H 14/00

[52] U.S. Cl. ..... 52/28; 52/38; 40/467

[58] Field of Search ..... 52/28, 29, 202, 105, 52/235, 38; 40/450, 451, 452, 447, 466, 467, 487

[56] References Cited

U.S. PATENT DOCUMENTS 4,110,922 9/1978 Leemann-Dittmann ..... 40/447
4,447,995 5/1984 Fulcher ..... 52/105 X

*Primary Examiner*—David A. Scherbel
*Assistant Examiner*—Creighton Smith
*Attorney, Agent, or Firm*—Foley & Lardner

[57] ABSTRACT

An illuminated display for displaying logos, messages, pricing information and the like, utilizes the large glass surfaces of modern office buildings, banks, hotels and shade material adapted to be backlit from the building interior. The shade material may contain translucent and opaque portions configured to provide, when combined with adjacent shade portions, a representation of the information to be conveyed to an observer of the structure. In the most preferred embodiment the shades are coupled to a timer mechanism so they may be operated simultaneously, e.g. to close them at sunset or to open them at sunrise. Various degrees of transparency may be provided, as may color, to give the designer a large selection of options for carrying out the informational and artistic aspects of the invention.

8 Claims, 2 Drawing Sheets

ILLUMINATED DISPLAY

BACKGROUND OF THE INVENTION

1. Field of the Invention

The present invention relates generally to the art of illuminated displays, and more particularly to display systems which employ the window areas of buildings, such as office buildings, hotels, banks and the like to convey informational or artistic images to an observer.

2. Description of the Prior Art

The use of signs on buildings to provide information is well known, as exemplified in most big city skylines. An observer today would note logos of insurance companies, banks, manufacturing and service companies, hotels and the like. In many cases the logos are painted onto the structure, and some may be illuminated for nighttime viewing by lighting directed at the building. Others may be made from translucent plastic materials (usually colored) which contain internal lighting to provide viewing capability during the day or at nighttime. Other systems in common use include various electronic display devices, e.g. the time, temperature and interest rate signs used by numerous banks.

It has also been proposed to use the building structures as a "screen" for receiving an image, as is the case with some relatively new laser technology. Furthermore, in some instances it has been proposed to use the windows of certain large buildings to provide information by illuminating only certain ones of the windows in a preselected pattern, darkening surrounding windows to convey the desired information.

While these latter two systems differ substantially from merely adorning a building with a sign, logo or electronic display, the former is very expensive and effective mainly in situations where a building stands apart from other illuminated structures. The latter suffers from a lack of detail and the need to isolate building areas from employees who may be working late, in which case windows other than those preselected for the desired pattern would be illuminated.

Another type of illuminated display is that used by filling stations, convenience stores and the like which employ a translucent, usually internally illuminated, cabinet, having a plurality of open areas for displaying information, e.g. the price of a gallon of gasoline. Some of these displays are very large, as exemplified by the highway signs mounted many feet above the ground on huge poles. Observers receive information from electronic displays or in some cases from scrolling rolls of transparent film having opaque indicia on them. Electronic controls allow the individual scrolls to be adjusted so that the price display may be changed. These devices provide illuminated displays of information at discrete openings.

To the knowledge of the present inventor, no building display systems are known in which different displays in adjacent window openings interact to create an overall artistic or informational impression. Such a system would provide very substantial opportunities to artists and provide users of the system with opportunities to provide information, advertize their goods or services, obtain advertising income from others or create unique visual statements of an artistic nature designed to enhance the appearance of a skyline or an individual structure.

SUMMARY OF THE INVENTION

A feature of the present invention is the ability to convert a plurality of openings of a building into an illuminated display by providing screening units which are adapted, in combination, to provide a plurality of open (or transparent) and closed (opaque or translucent) locations which define an artistic or informational display. The screen devices can be colored in another aspect of the invention, and in the preferred embodiment, the normal interior lighting of the building is used to backlight the screen devices so that someone observing the building from outside will be able to view the display.

In other aspects of the invention, the screen devices may be automatically extended across and retracted from the window openings, e.g. to have the display viewable in the evening without interference with normal use of the window during the day. In a further embodiment of the invention, the screen devices can be lit from auxiliary lighting behind the screen devices, so for example, light tight curtains could be used to darken the window of the room. This embodiment would be useful in a hotel building, where an occupant would not want to be bothered by the display lighting.

Other embodiments of the invention will be described in connection with the drawings or will become apparent to those skilled in the art after the present specification has been read and understood. In the most preferred example as described in detail below, a plurality, sixteen in the illustrated system, of windows of a high rise office building are each equipped with a rolled shade device with an automatic roller control motor adapted to unroll each of the shades at about the same time, e.g. at sundown. The individual shades may include solid and/or translucent portions or both, which in combination with other portions of that shade and the solid and translucent portions of the adjacent shades define a display. The display selected for the illustrated embodiment is that of an imaginary corporate logo. In the illustrated embodiment translucent portions are used, but transparent portions could also be employed. As will be apparent from the description below, proper choices of transparency or opaqueness, coloring and lighting can be used to create a nearly limitless choice of highly desirable artistic and informational displays.

DESCRIPTION OF THE DRAWINGS

In the various FIGURES, like reference numerals are used to illustrate like elements.

DETAILED DESCRIPTION OF THE PREFERRED AND ALTERNATE EMBODIMENTS

Figure 1:
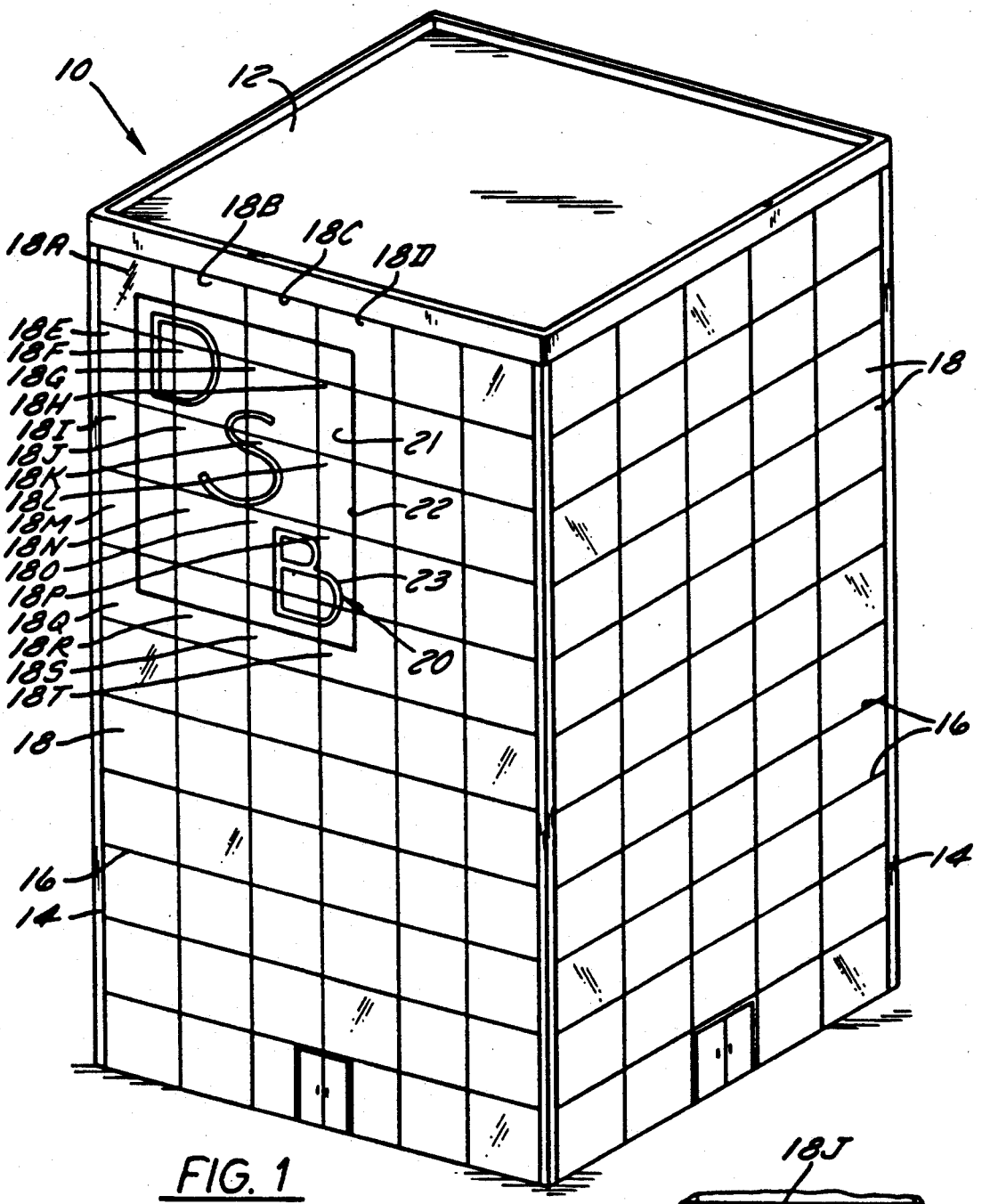
FIG. 1 is a perspective view of a building incorporating the illuminated display of the present invention.

Before proceeding to the detailed description of the preferred and alternate embodiments, several comments will be made to provide background and to illustrate the wide variety of illuminated displays which can be prepared using the principles of the present invention.

First, the number of shade devices which may be combined to produce a display using the present invention can be from as few as two to as many as the number of windows on a particular building. The drawings show the present invention used in a typical modern office structure having many floors, where illuminated displays may have the greatest impact on nighttime visitors and people who will be exposed to the upper stories of such structures from landing or departing airplanes, highways, etc. However, the present invention can be employed with much smaller buildings, such as those found in suburban office parks and with motels, hotels, banks, factories and the like.

Second, the type of display, artistic or informational, can vary over a wide range. In the drawings a logo of an imaginary company "DSB" is portrayed on a surrounding square, with the colors being black on white, as is necessary in the patent application process. However, it should be apparent at the outset that the colors could be reversed or could be selected from any color of the rainbow. In addition to color, the brightness of any part of the display can be varied in a number of ways. For example, the intensity of the backlighting could be changed or the degree of transparency of any particular portion could vary from opaque to clear, and any of the techniques presently known in the graphics art field could be used to create striking artistic or informational displays.

Proceeding now to the explanation of FIG. 1, the upper floors of a building structure 10 are shown. Structure 10 is constructed from a roof 12, vertical support elements 14, floors 16, all of which may be conventional. They are not shown in detail because, in and of themselves, they form no part of the invention. Between floors 16 are located a plurality of windows 18, which in the illustrated embodiment are floor to ceiling windows. Sixteen of the windows 18 lying along one corner and the roof in a 4×5 pattern are employed for the illustrated display of the present invention. For clarity in explanation, they will be designated 18A–18T in the upper left corner of each. The selection of these sixteen windows is merely for illustration and the pattern could certainly be larger or smaller. Moreover, the display could be used on an additional side or on all four sides of the building if desired. An imaginary logo has been chosen for purposes of the description and a simple one at that. The logo 20 comprises a white background 21, a black line forming square 22 and three letters 23, i.e. "DSB" in a fanciful arrangement. The logo 20 is arranged so that it is centered in the 4×5 pattern of windows 18, as will be more fully described below. Each of shade devices 18A–18T will have a component of the logo on it and be adapted to be placed over the window openings to substantially cover them, with lighting supplied from the back.

Figure 2:
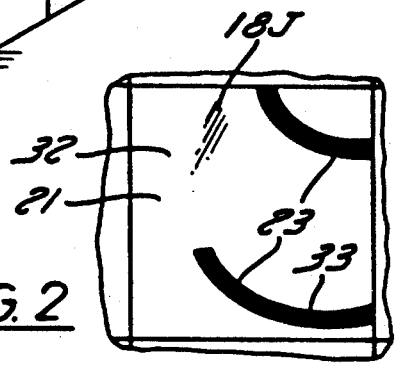
FIG. 2 is a front elevation of the window section of the building of FIG. 1 which is employed for the illuminated display of the preferred embodiment of the present invention.

Shade 18J is illustrated in FIG. 2 in a larger view to include a generally white background over which several of the components of the letter "S" pass. Many of the remaining shades would have at least some black portions resulting from the surrounding square line or a part of one of the letters DSB.

Discussing now in greater detail the construction of the shade devices themselves, a translucent material for the white portions 32 of shade device 18J is preferred because with proper backlighting, a bright white can be obtained. Clear material, such as transparent plastics could certainly be used, but they suffer the disadvantage of exposing the building contents. Providing a separate background sheet inside of such clear material would achieve the desired effect. Cloth, resins, glass mat, and a large number of other materials known for window treatment can be used for the various components of shade devices 18A–18T. They may be combined by sewing, adhesives, printing and the like, and the materials themselves may be dyed to almost any shade. Optical brightners, phosphorescent materials and related enhancements can also be used. The dark portion 33 can be prepared using the same materials and techniques in a huge variety of colors and optical densities. While a simple three letter logo has been shown here, the complexity could be much, much greater.

Instead of the two colors employed in the illustrations in FIGURES 1 and 2, any number could be employed for artistic purposes or various tones of the same color may be used. Since the resultant illuminated display will be so striking, and since the resultant display will be long lasting, the costs incurred in creating the initial display can be amortized over a long period, thereby justifying the constructions costs.

Figure 3:
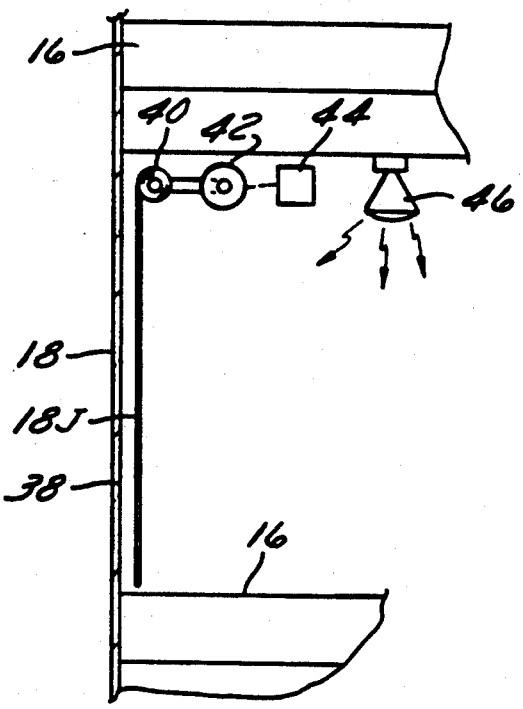
FIG. 3 is a side cross-sectional view taken vertically through one of the display areas shown in FIGS. 1 and showing in diagrammatic form the window frame, glass, shade device, roller, roller motor and illumination components of the preferred embodiment of the display device of the present invention.

Proceeding now to FIG. 3, a representative and very schematic illustration is provided to show how an individual shade device might be mounted. The window 38 is shown between floors 16 and a shade device 18J is mounted to the inside thereof. A rod 40 mounts the shade, rod 40 being supported from suitable brackets (not shown) so that it may be rolled to wind shade device 18J across the opening of window 38. Shown schematically coupled to rod 40 is a motor 42, the output shaft of which may be coupled to rod 40 through simple gearing techniques to permit such winding and unwinding. Also shown in FIG. 3 is a timer 44 coupled to the motor 42, so that the winding and unwinding can be set to occur at a preselected time of day, e.g. at sunrise and sundown respectively. Finally, a ceiling light 46 is shown in FIG. 3 to provide the backlighting to illuminate shade device 18J.

While FIG. 3 is very basic, it will serve to illustrate a number of aspects of the present invention. For example, while a motorized system is employed for winding and unwinding, a manual system could be used, with the obvious drawback that someone would need to unwind and wind the shade devices of each window. In addition, while the timer is shown coupled only to the motor, it could also be coupled to the light as well.

The shade devices 18A–18T could also take numerous forms beside the illustrated form which resembles a common rolled window shade. Other examples include, but are not limited to, traverse mounted pull shades (resembling curtains), horizontally or vertically mounted blinds, etc. These possibilities further expand the variety of construction techniques and visual alternatives which exist with the present invention.

A still further feature of the present invention is the incorporation of the illustrated display into the buildings environmental control system. In this feature the individual shade devices may be employed for energy conservation purposes, and may be integrated with other systems (heating, cooling, security, air quality, etc.) to provide total building control. In such cases, the individual system used to wind and unwind, or close and open, the shade device 18A–18T would be coupled one to the other to be operated at the same time according to the building's master control procedures.

Figure 4:
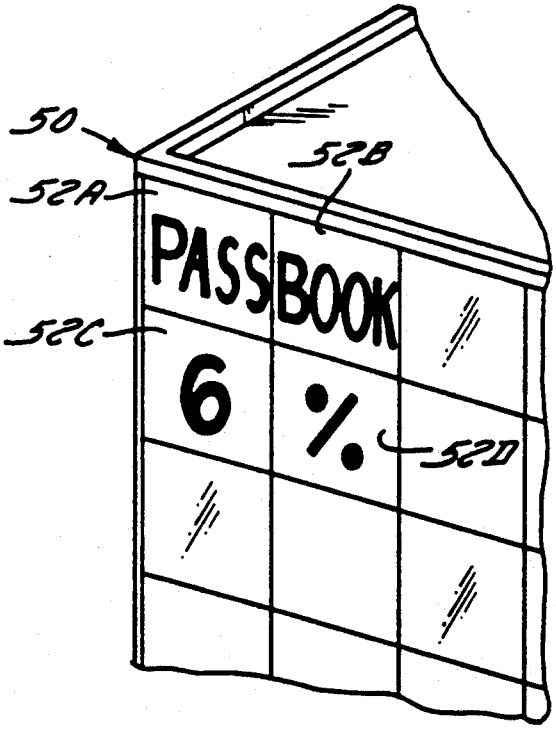
FIG. 4 is a view similar to FIG. 3 but illustrating an alternate illumination technique for the shade device.

FIG. 4 shows another embodiment of the invention where a building structure 50 uses as few as four windows and four shade devices 52A–52D to provide an illuminated display. Each shade device 52A–52D has relatively more portions of information on it then did shade devices 18A–18T, thus again illustrating the adaptability of the present invention. It can also be noted from the FIGURE, illustrating an illuminated bank display of current interest rates, that one panel 52C may be changed to reflect changes in the financial markets.

Figure 5:
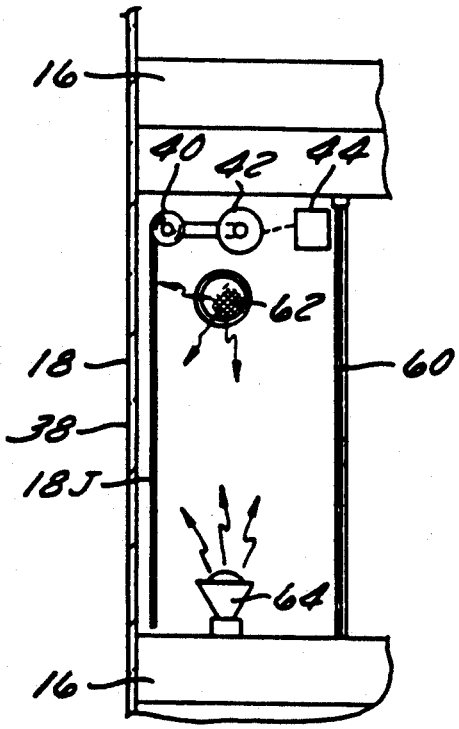
FIG. 5 is a perspective view of an alternate embodiment of the present invention and illustrating a lesser number of shade devices and an alphanumeric display.

Proceeding next to FIG. 5, a representation is shown which is similar to FIG. 3, except that a different system is employed to backlight the shade device 18J. In this case, a separate isolation curtain 60 is located inwardly of shade device 18J and various lights 62 and 64 are provided in the space between the shade device and curtain to provide the necessary backlighting. In addition to enhancing the evenness of the backlighting achieved, this technique can be used to isolate the display from the interior of the structure. This might be especially helpful, for example, if the display were to be used in a hotel building where isolation of the display from the guest's room would be desirable. In such a case, light 46 would not play a part in the display system.

While a preferred embodiment and two alternate embodiments have been described in this specification, they are to be taken as illustrative, rather than limiting. Those skilled in the display art will be able to construct numerous other illuminated displays which will fall within the scope of this invention, which scope is to be limited solely by the claims which follow.

What is claimed is:

1. An illuminated display comprising a building having a plurality of transparent windows, shade devices for at least two adjacent ones of said windows, each of said shade devices including a portion of a display, said shade devices being adapted, only in combination, to transmit an artistic or informational display to observers of said building when light is passed therethrough from the interior of the building, means interiorly of said building for backlighting said shade devices, and wherein at least two of said adjacent shade devices include in combination a first portion of relatively lower transparency and a second portion of relatively greater transparency, at least said first portion being located on more than one shade device.

2. The illuminated display of claim 1 wherein each of said shade devices is movable into and out of position across said windows.

3. The illuminated display of claim 2 wherein said shade devices are rolled onto a shaft.

4. The illuminated display of claim 3 including a motor means coupled to said shaft for selectively moving said shade devices into and out of position across said windows.

5. The illuminated display of claim 4 wherein said motor means is coupled to a timer means for operating said motor at preselected times.

6. The illuminated display of claim 1 wherein said means for backlighting comprises building room lighting.

7. The illuminated display of claim 1 wherein said means for backlighting comprises light emitting means specially adapted for such purpose.

8. An illuminated display comprising a building having a plurality of windows, shade devices for at least two of said windows, each of said shade devices including a portion of a display, which display is defined by combining the portions of all of said shade devices, said shade devices being adapted, in combination, to transmit an artistic or informational display to observers of said building when light is passed therethrough, and means interiorly of said building for backlighting said shade devices, wherein said means for backlighting comprises light emitting means specially adapted for such purpose and wherein the illuminated display includes curtain means interiorly spaced from said shade devices, and wherein said light emitting mean sis located intermediate said shade device and said curtain.

* * * * *